United States Patent [19]

Seney

[11] 4,297,772

[45] Nov. 3, 1981

[54] AUTOMATIC COVER FOR YARN BULKING JET APPARATUS

[75] Inventor: John S. Seney, Seaford, Del.

[73] Assignee: E. I. Du Pont de Nemours and Company, Wilmington, Del.

[21] Appl. No.: 151,898

[22] Filed: May 21, 1980

[51] Int. Cl.[3] ..... D02G 1/16

[52] U.S. Cl. ..... 28/257; 28/272

[58] Field of Search ..... 28/257, 272

[56] References Cited

U.S. PATENT DOCUMENTS 3,261,071 7/1966 Clendening, Jr. et al. .
3,324,526 6/1967 Burns et al. .
3,638,291 2/1972 Yngve .

*Primary Examiner*—Robert Mackey

[57] ABSTRACT

A two-piece yarn bulking jet is automatically opened and closed for yarn stringup by means of a pneumatically operated piston connected to a rod which in turn passes through the jet body and is attached to the jet cover. The piston is powered by the same pressurized fluid supply used to supply the bulking fluid to the jet apparatus.

4 Claims, 3 Drawing Figures

AUTOMATIC COVER FOR YARN BULKING JET APPARATUS

DESCRIPTION

1. Technical Field

This invention relates to an apparatus for automatically opening and closing yarn bulking jets during yarn string-up operations. More particularly, it relates to a pneumatically operated bulking jet opening and closing mechanism which is energized by the same source of bulking fluid used for the jet.

2. Background Art

Fluid jet apparatus for bulking continuous filament yarns is conveniently made in two pieces, a body side which is supplied with a pressurized fluid, and a cover separable from the body to permit stringing up of a yarn through the apparatus. One simple means of securing the cover to the body is shown for example in FIG. 1 of Yngve U.S. Pat. No. 3,638,291 wherein a single threaded fastener, i.e., a screw, is used to hold the two together. Opening such a jet for cleaning or yarn string-up requires a manually operated tool accompanied by the risk of accidental damage to the apparatus and surrounding equipment. Eliminating the need for a separate tool by providing a screw with an extended handle which can be used to loosen and tighten the cap by hand can reduce the risk of damage by tool misuse but tends to obstruct the operating area in the vicinity of the cover. An automatic arrangement for opening and closing such jets pneumatically is disclosed for example in FIGS. 3 and 4 of Clendening et al. U.S. Pat. No. 3,261,071 and in FIG. 3 of Burns et al. U.S. 3,324,526 wherein pneumatic pistons operating from the outside of the jet cover can remove or place the cover in the operating position and exert force against it when operating. Whereas such mechanisms eliminate the need for manually moving the cover and thereby minimize the time and steps required for making a yarn string-up, they also obstruct the operating area in the operating area of the jet apparatus. Moreover, the added structure attached to the cover can create heat problems, losses and nonuniform treatment when a hot fluid and multiple jets are used.

An object of this invention is an improved apparatus for automatically opening and closing the cover of a two-piece bulking jet without obstructing the operating area in the vicinity of the cover, and which, with hot fluids, reduces conductive heat losses from the jet cover by the cover actuating mechanism thus helping to reduce heat nonuniformities during yarn string-up.

DISCLOSURE OF THE INVENTION

This invention provides in a yarn-treating jet apparatus, including a jet body, a cover and means for positioning said body and said cover with respect to one another alternatively in a contiguous operative closed position and in a spaced-apart inoperative open position, said body and cover when in closed position forming a longitudinal passage between them through which yarn can be passed for treatment, at least one conduit in communication with said yarn passage for directing fluid against the yarn while in said passage, a pressurized fluid supply connected to said conduit, the improvement in said means for positioning said body and cover comprising a longitudinally moveable actuating rod having a head end fastened to said cover, an opening extending entirely through said body at a location remote from said conduit and said yarn passage, said rod projecting substantially perpendicularly from the body-contacting surface of said cover in alignment with and freely passing through said opening in said body, said rod having an end protruding beyond said body from said opening, said protruding end being operatively connected to a spring powered first moving means for continuously exerting a longitudinal force on said rod for moving said cover into said open position in the absence of any counterforce, said protruding end also being operatively connected to a second moving means for exerting a greater longitudinal counter force on said rod for moving and holding said cover in said closed position by overcoming said first moving means, and said second moving means being pneumatically powered by fluid from said pressurized fluid supply.

Since it is a useful practice to stop the supply of fluid to said conduit when said body and cover are in the open position, for string-up or for cleaning, it is preferred that means be provided for supplying said pressurized fluid to power said second moving means only when said fluid is also being supplied to said conduit. Consequently, whenever the fluid supply is shut off to the fluid conduit the cover automatically releases to its inoperative position.

Additional benefits of the invention are realized when the fluid supply is heated, such as hot air or steam, and said jet body is fastened to a heated manifold for said fluid supply, and the actuating rod passes through and is heated by the manifold at a point between the jet body and where the rod is connected to both moving means for actuating the cover. This arrangement further helps to keep the cover at a uniform temperature.

Figures 1, 2:
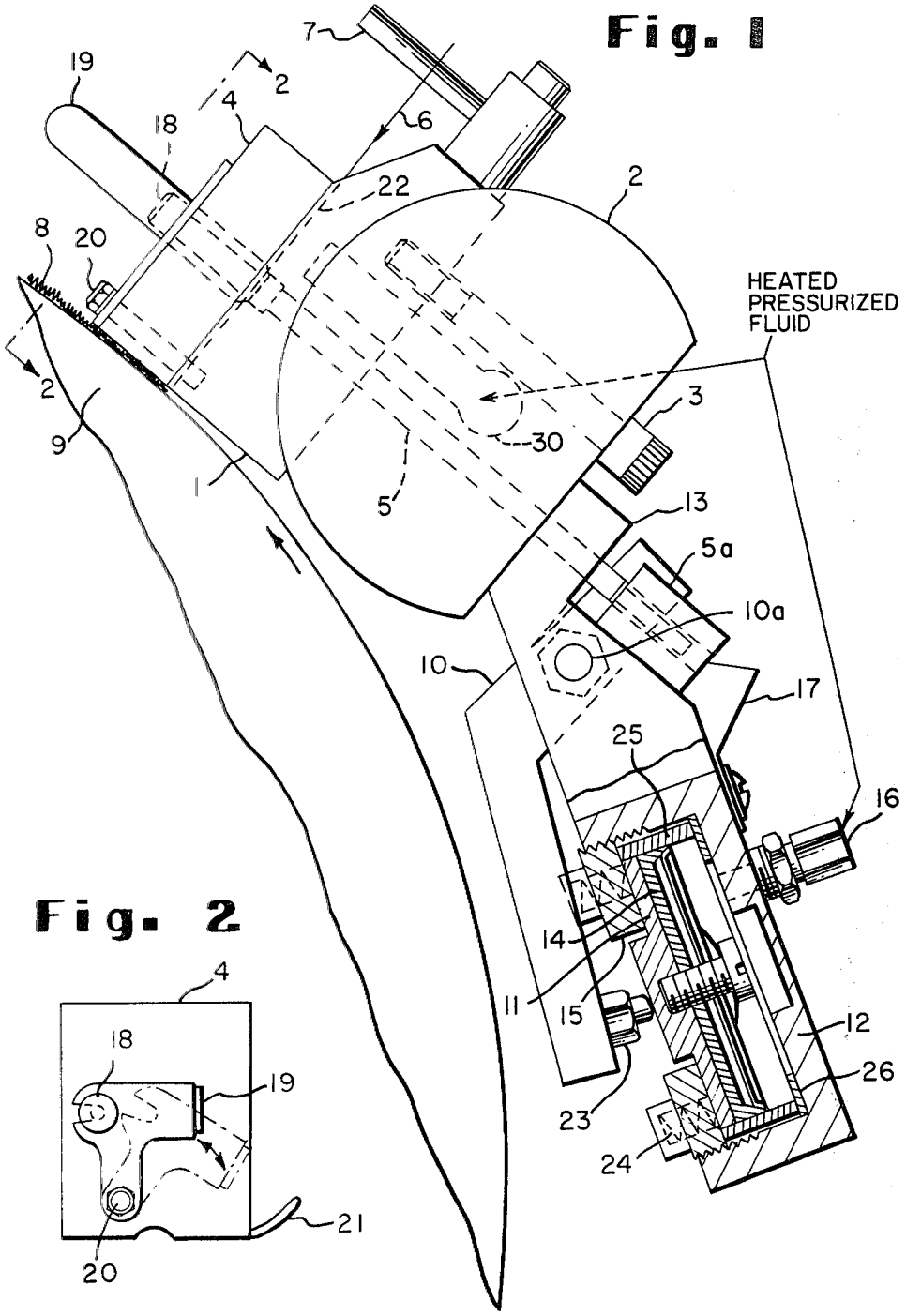
FIG. 1 is an elevated view of a preferred device of the invention shown partially cut away and including an actuating rod connected at one end to a jet cover and on the other end connected by means of a lever with a piston which exerts a force to hold the cover in closed position.
FIG. 2 is an elevational view of the jet cover seen from direction 2–2A of FIG. 1 and showing the operation of a quick release clip which permits complete removal of the cover when desired.

In FIG. 1, jet body 1, which may be of the type as shown for example in Yngve U.S. Pat. No. 3,638,291, is fastened to fluid manifold 2 by screw 3. The Figures and specification of U.S. Pat. No. 3,638,291 are incorporated herein by way of reference. Fluid manifold 2 leads heated air or steam to jet body 1 and to yarn passage 22 by a conduit 30. The manifold may be separately supplied with a heat transfer fluid to maintain a uniform temperature. Jet cover 4 is shown in normal operating closed position clamped tightly to body 1 by actuating rod 5. Yarn 6 is guided into the passageway 22 by guide pin 7 and emerges as a bulked yarn product 8 on the surface of travelling screen drum 9. Actuating rod 5 is held in clamping position by force exerted through lever arm 10, its pivot **10*a* and adjustable set screw 23, which force is provided by piston 11 operating within cylinder 12 which is either integral with or supported by bracket 13. Bracket 13 is attached to manifold 2 by one or more screws (not shown). Piston 11 is sealed within cylinder 12 by piston cup 14 which is preferably of polytetrafluoroethylene or similar material which has adequate lubricity and durability at any hot temperatures which may be encountered. Piston 11 is secured within cylinder 12 by retainer ring 15 and is operated by compressed fluid which enters cylinder 12 through port 16 by means of a pipe connection shown schematically to the same source of fluid supply for fluid manifold 2. The piston construction also includes two compression piston-return coil springs 24, cylinder sleeve 25 and gasket 26**.

When the jet apparatus is to be opened for yarn string-up, a manual or automatic switch operating a control valve (not shown) releases the fluid pressure, i.e., shuts off the supply, preferably to both yarn passageway 22 and piston 11, allowing spring 17 to move actuating rod 5 toward a slightly retracted position releasing the clamping force on cover 4 against body 1. Cover 4 may remain in contact with jet body 1 by gravity until the tension of the yarn being strung-up into the apparatus acting on string-up yarn guide 21 pulls at least an edge of cover 4 away from body 1 sufficiently to let the yarn enter the yarn passageway. By this means, cover 4 continues to receive heat from fluid manifold 2 except at the brief instance of string-up, thus maintaining its operating temperature. The amount of movement permitted cover 4 during string-up is regulated by the degree of engagement of a threaded end of protruding actuating rod 5 within block 5*a*, which is in turn operated by a linkage to lever arm 10. Actuating rod 5 is heated to the temperature of the supply fluid by passing through heated fluid manifold 2 and therefore does not conduct heat from cover 4. Heat transferred to the piston mechanism may be reduced by providing thermal insulation between bracket 13 and manifold 2 as desired.

In FIG. 2, head 18 of actuating rod 5 is fastened to jet cover 4 by a quick release clip 19 which is fastened to cover 4 by screw and spring washer 20. When cover 4 is to be completely removed from the assembly, quick release clip 19 is moved to a position such as that shown in phantom in FIG. 2 so that cover 4 can slide away from the assembly along and over the head end of actuating rod 5 by means of an access hole through cover 4 which is slightly larger than head 18. Quick release clip 19 may have a protruding handle arranged in various positions to reduce the obstruction of the operating area but at the same time to be readily accessible when the cap is to be removed.

Figure 3:
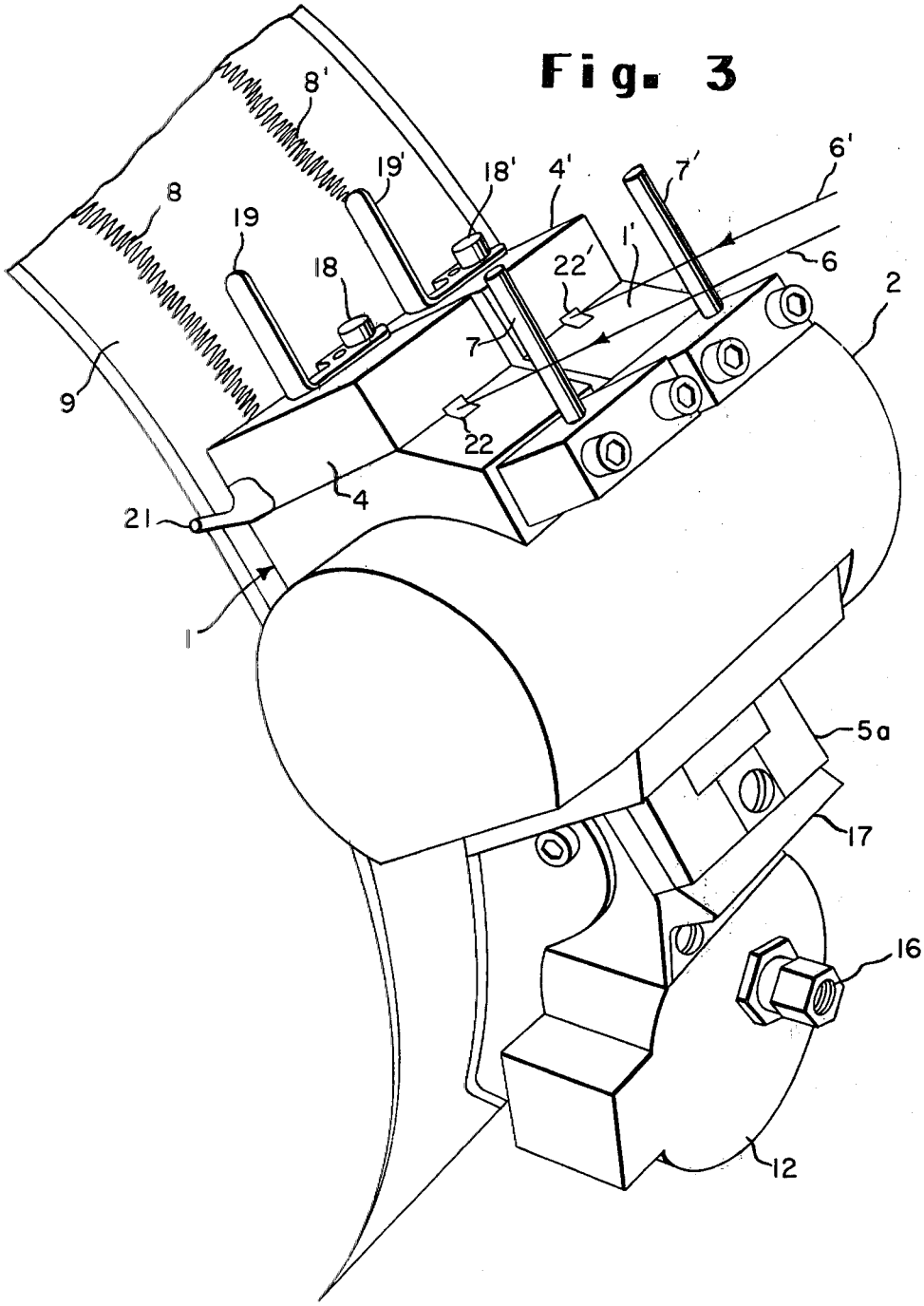
FIG. 3 is a perspective view of the apparatus of the type in FIG. 1 with two adjacent jet body and cover assemblies being operated by a single piston mechanism.

FIG. 3, in perspective view, shows heated fluid manifold 2 having mounted on it two jet bodies 1,1' of the type in FIG. 1 with their respective covers 4,4'; yarn passages 22,22'; yarns ends 6,6'; guide pins 7,7'; actuating rod heads 18,18'; release clips 19,19' and bulked yarn products 8,8' on travelling screen drum 9. Also shown is string-up yarn guide 21 which during string-up engages yarn 6 and facilitates moving cover 4 from body 1 to allow the yarn 6 to enter passageway 22. Both jet covers are operatively connected, for simultaneous operation, through actuating rods 5,5' (not shown) and block 5*a* to a single pneumatic cylinder 12 having a fluid supply through port 16 by means of a pipe connected to the fluid supply in manifold 2.

The piston assembly may either be arranged as shown in FIGS. 1 and 3 for easy access by the operator or, if such space is needed otherwise, the mechanism may be turned perpendicularly to the plane of the Figure or in any other convenient arrangement depending upon the requirements of the installation.

While the jet bodies and caps of the present figures show a single yarn threadline per jet body, it is obvious that multiple threadlines and yarn passages can be accommodated such as by having actuating rod 5 in the middle of a jet assembly with one threadline on each side and each yarn being inserted from opposite sides of the cover. Thus, equal force would be exerted by the rod on a cover for sealing each of the two threadlines.

The present device permits rapid operation which reduces time that the cover is out of contact with the hot jet body and the time required for string-up as well as the time that the flow of hot fluid is interrupted thereby increasing productivity and reducing energy loss. By this invention jet opening and closing is provided without any additional source of power.

EXAMPLE

A pneumatically operated, bulking jet opening and closing mechanism of the type shown in FIG. 3 is installed on a spinning machine for manufacturing nylon bulked continuous filament carpet yarns. The pneumatically operated mechanism includes a main body which houses a 2-inch (50.8 mm) inside diameter cylinder containing a metal piston holding on its top a poly(tetrafluoroethylene) piston cup and a piston cup retainer which is used to force the piston cup outward against the walls of a cylinder sleeve in the cylinder. A screw and a Belleville spring are used to fasten the piston cup and retainer to the top of the piston. The piston assembly is secured by a piston travel limit nut (retainer ring) which houses two bosses containing piston return springs to force the piston into a closed position when bulking fluid pressure is removed from the cylinder. The main body is attached to the bottom side of a bulking fluid manifold which supplies hot air under pressure to the bulking jet. An actuating rod saddle block spans the back of two jet bodies. Two pull down or actuating rods, one for each jet, pass through a quick-release half-moon clip on the cover of each jet, through each cover, jet body, the bulking fluid manifold and then screw into the saddle block. The jet cover closing force is applied to the saddle block by a pivoted force lever arm which connects the piston to the saddle block. This lever has a force amplifying ratio of about 5:1 and represents a pull down pressure of 1884 lbs. (856 kg) to the center of the saddle block when using a bulking fluid pressure of 120 lbs/inch$^2$ (9.43 kg/cm$^2$). A spring forces the saddle block and pull down actuating rods in the opposite direction when bulking fluid pressure is removed from the cylinder, thus releasing the jet covers for yarn spring up. A half-moon quick release clip made of spring steel which pivots around a threaded stud fastens the actuating rod to the jet cover. The end of the clip furthest from the pivot is bent down and snapped into a hole in the jet cover which retains the clip in closed position. The half-moon cut out of the clip is inserted under the head of the actuating rod and transmits the pull down pressure to the jet cover. Manually rotating the quick release clip from under the actuating rod head frees the jet cover for complete removal. A small stainless steel tube connects a cylinder port to the bulking fluid supply through an access port in the manifold.

The mechanism meets commercial operating standards of operability, reliability and durability and results in a significant reduction in string-up time as compared to jet covers held in place by a screw.

I claim:

1. In a yarn-treating jet apparatus, including a jet body, a cover for said body, and means for positioning said body and said cover with respect to one another alternatively in a contiguous operative closed position and in a spaced-apart inoperative open position, said body and cover when in closed position together forming a longitudinal passage between them through which yarn can be passed for treatment, at least one conduit in communication with said yarn passage for directing fluid against the yarn while in said passage, and a pressurized fluid supply connected to said conduit, the improvement in said means for positioning said body and cover comprising a longitudinally movable actuating rod having a head end fastened to said cover, an opening extending entirely through said body from front to back at a location remote from said conduit and said yarn passage, said rod projecting substantially perpendicularly from the body-contacting side of said cover in alignment with and freely passing through said opening in said body, said rod having another end protruding beyond said body from said opening, said protruding end being operatively connected to spring powered first moving means for continuously exerting a longitudinal force on said rod for moving said cover into said open position in the absence of any counterforce, said protruding end also being operatively connected to a second moving means for exerting a greater longitudinal force on said rod for moving and holding said cover in said closed position by overcoming said first moving means and means for pneumatically powering said second moving means with fluid from said pressurized fluid supply.

2. The apparatus of claim 1 including a means for heating said pressurized fluid supply.

3. The apparatus of claim 2 wherein said fluid supply is a heated manifold, said jet body is fastened to said manifold and said protruding rod passes through and is heated by said manifold between said body and said operative connections whereby conductive heat losses from said cover by said actuating rod are reduced.

4. The apparatus of claim 1 or 2 including synchronizing means for powering said second moving means with said pressurized fluid only when said fluid is being supplied to said conduit.

* * * * *